United States Patent [19]

Messinger

[11] Patent Number: 4,583,765

[45] Date of Patent: Apr. 22, 1986

[54] MULTI-COPY SELF-STICK LABEL SET

[76] Inventor: Emanuel Messinger, 23 HoneySuckle Row, Sunset Ridge St. James, Barbados, 20334

[21] Appl. No.: 542,759

[22] Filed: Oct. 17, 1983

[51] Int. Cl.[4] ..... B41L 1/20; B42D 15/00; B42D 5/00

[52] U.S. Cl. ..... 282/9 R; 283/79; 283/81

[58] Field of Search ..... 282/9 R, 8 A; 283/74, 283/79, 81; 428/40

[56] References Cited

U.S. PATENT DOCUMENTS

| | | | |
|---|---|---|---|
| 2,648,924 | 8/1953 | Brewster | 428/40 |
| 3,257,228 | 6/1966 | Reed | 428/40 |
| 3,332,829 | 7/1967 | Avery | 428/40 |
| 3,854,229 | 12/1974 | Morgan | 283/81 |
| 3,987,960 | 10/1976 | Gardiner | 283/81 |
| 4,004,058 | 1/1977 | Buros et al. | 283/81 |
| 4,248,919 | 2/1981 | Davis | 282/8 A |
| 4,335,172 | 6/1982 | Sato | 283/81 |

*Primary Examiner*—Paul A. Bell
*Assistant Examiner*—Paul M. Heyrana, Sr.
*Attorney, Agent, or Firm*—Stephen E. Feldman

[57] ABSTRACT

A plurality of labels is disclosed which are formed from contact type film material and to a predetermined height and width. Each label includes an information surface on one side thereof and an attaching surface, on the obverse side, coated with a light tack self-stick adhesive. A bottom label is removably affixed to a carrying member formed with a suitable release surface and so as to extend wider than the label to provide an attaching edge. An upper, and all intermediate labels are removably affixed to one surface of film-type transfer member having an exposed carbonized surface adapted, under pressure, to act as carbon paper to transfer an image to an adjacent member. The transfer members extend wider than their labels to also provide attaching edges. All labels are bent over along one edge to facilitate removal from their carrying members. The attaching is by staples. A label set is prepared by fastening together, utilizing the attaching edges, a bottom label, an upper label, and if desired, one or more intermediate labels. Each set is arranged so that the carbon transfer surface is disposed adjacent the information surface of the next label so that writing, typing, or other impact printing on the top label with sufficient pressure will result in the information appearing on all the labels.

5 Claims, 2 Drawing Figures

MULTI-COPY SELF-STICK LABEL SET

BACKGROUND OF THE INVENTION

1. Field of Application

This invention relates to labels and more particularly to multi-copy label sets.

2. Description of the Prior Art

It is often necessary to place information upon an item to identify the item, its contents, its owner, or location where the item is being sent and possibly a person at that location to receive the item. Whether the item is a letter, package or parcel that is being mailed, shipped, air transported, or otherwise to be delivered; or the item is a package or suitcase that is being carried from one place to another, it is important that a proper identification be placed upon the item to show its owner (sender) and possibly who is to receive the item. Similarly it is quite often, important, if not obligatory, to identify items such as drugs after they have been placed in their containers and prior to their being given to the user. There are numerous other times and situations where identification and labelling are important and necessary.

Placing owner (sender) and receiver identification upon packages to be mailed or otherwise delivered is quite often accomplished by merely writing the respective names and addresses upon the package. Many senders prefer to put the names and addresses on two or more sides of the package in case one side is damaged or the information thereon should become otherwise obscured. However, writing names and addresses a number of times is time consuming; and for many persons a distastful chore.

Owner identification must be similarly placed upon suitcases, carry-on items, and other luggage when taking a trip by airplane, train, boat or the like. Many times in the haste of packing and getting away the luggage tags are forgotten until check-in time. Then, quite often and while on line at the check-in counter, multiple, string tags have to be filled in and tied onto the luggage. This is a cumbersome task and usually not only annoying to the party filling in the tags but also to everyone else on line.

At other times, it is important to make and keep a record of the items contents, destination, and other pertinent details. This is a usual practice for pharmacies and the like. In essence, the party creating or filling in the label has to generate an additional record with the same, or substantially the same information placed upon the label.

The availability of self-stick labels have helped to minimize the problems of tie-on labels and tags, or labels and tags which are strapped on or otherwise attached to the package. Not only is it time consuming and sometimes difficult to tie or strap such labels and tags on the package, but such labels and tags often get torn off the package thus leaving it unidentified. However, many available self-stick labels are provided on sheets or rolls but as individual, separate and distinct items. Thus, if a number of identical labels are required, as for multiple pieces of luggage, or multiple addresses on a package, or where a copy of the label information is to be retained for record purposes; the user must still write out, or type out, the information a number of times. The user must also purchase and/or carry a roll or sheet of such labels in order to have them available for use.

Some self-stick labels are available as individual items, thus avoiding the necessity to purchase, store, and manipulate a whole sheet or roll of labels; but not avoiding the problem of multiple copying of identical information on multiple labels. However, self-stick labels such as those shown and described in U.S. Pat. No. 4,248,919 granted on Feb. 3, 1981 to Ronald A. Davis for Business Form and in U.S. Pat. No. 3,459,626 granted on Aug. 5, 1969 to B. D. Morgan for Label Carrier and Release Laminate are not only relatively complex in their respective constructions and constituent elements but still require that each label be individually completed, even though they are to contain identical information. On the other hand, available self-stick labels such as shown in U.S. Pat. No. 3,383,121 granted on May 14, 1968 to E. A. Singer for Self-Adhesive Copy Label require a relatively complex and expensive laminated arrangement of special elements in order to provide a label or labels and copy.

SUMMARY OF THE INVENTION

It is therefore an object of this invention to provide a new and improved label set.

It is another object of this invention to provide a new and improved self-stick label set.

It is still another object of this invention to provide a new and improved multi-copy label set.

It is yet another object of this invention to provide a new and improved multi-copy, self-stick label set.

It is yet still another object of this invention to provide a new and improved multi-copy, self-stick label set which is relatively simple in construction and use.

Other objects, features and advantages of the invention in its details of construction and arrangement of parts will be seen from the above, from the following description of the preferred embodiment when considered with the drawing and from the appended claims. In addition, these and other objects and advantages of the present invention will become evident from the description which follows.

BRIEF DESCRIPTION OF THE INVENTION

This invention involves a multi-copy, self-stick label set, and contemplates; utilizing one or more film-type self-stick labels, each initially applied to a film-type transfer sheet, and assembled into a set with a bottom film-type self-stick label carried by a release backing, and so that the transfer medium will transfer onto a lower label the information applied to an upper label in the set.

The invention accordingly consists in the features of construction, combination of elements, and arrangement of parts which will be exemplified in the system, device, and article of manufacture hereinafter described, and of which the scope of application is as elucidated supra and as will be indicated in the appended claims. In this regard, numerous alternatives within the scope of the present invention, besides those alternatives, preferred embodiments or modes of practicing the invention mentioned supra, and those to be elucidated, infra, will occur to those skilled in the art.

DESCRIPTION OF THE PREFERRED EMBODIMENT

Figure 1:
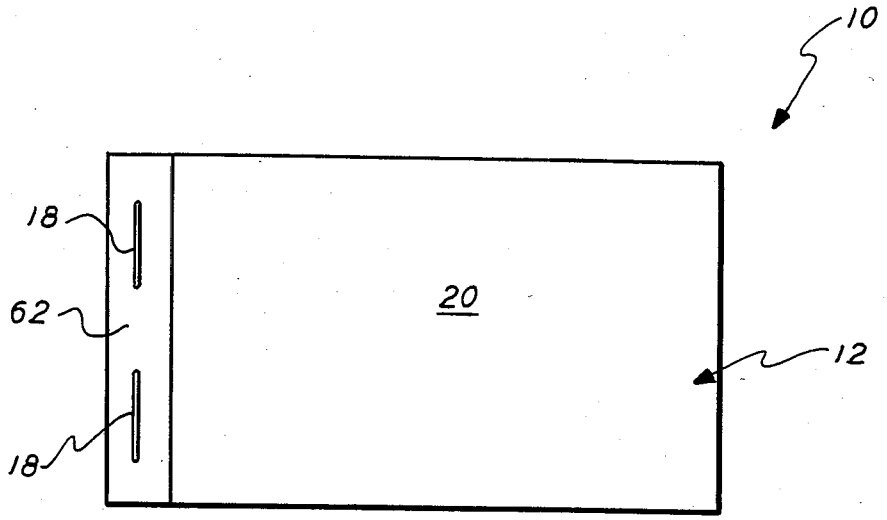
FIG. 1 is a plan view of a label set incorporating the instant invention.
Figure 2:
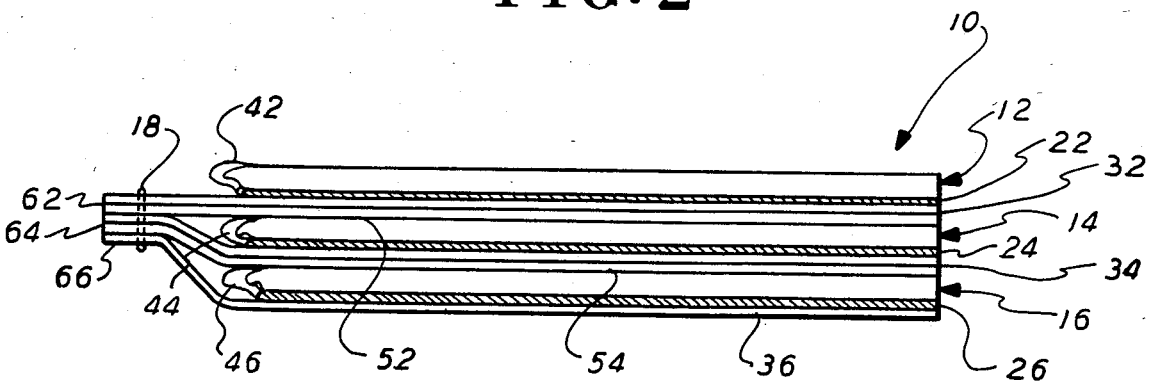
FIG. 2 is an end view of the label set of FIG. 1; greatly enlarged to better show details thereof.

With reference to FIGS. 1 and 2, there is generally shown at 10 a label set including a plurality of labels 12, 14 (FIG. 2) and 16 interconnected into a set by a fastening means such as one or more staples 18.

Labels 12, 14, and 16 are each formed of contact type vinyl film having an upper surface 20 upon which information may be placed by handwriting, typing, printing, or other similar methods. By utilizing a film stock for the label material, the label resulting therefrom can be relatively thin thus facilitating a relatively thin label set 10. Additionally, each label is also extremely durable and thus resists tearing or other destruction.

A suitable label stock of contact type film material could be, for example, one that is designated A21 Cohn-Hall-Marx. The film stock for labels 12, 14, 16 has a light tack self-stick adhesive layer 22, 24, 26 respectively applied to surface thereof opposite to information surface 20. Such an adhesive layer permits the application of each label 12, 14, 16 initially to a carrier within label set 10 and the removal thereof for application to the package, container or other item to which the label is to be affixed.

Upper label 12 and intermediate label 14 are disposed onto a transfer film layer 32, 34 respectively; while bottom label 16 is disposed onto a release layer 36. The adhesive layers 22, 24 and 26 acting as the medium for keeping labels 12, 14, and 16 so attached, but permitting easy removal of labels 12, 14 and 16 therefrom for subsequent attachment to an item. Each label 12, 14, 16 includes a bent over edge 42 (FIG. 2) 44, 46 respectively wherein their respective adhesive layers are bent over onto themselves to provide a readily available means to lift an edge of the label to facilitate its separation from its respective carrying layer 32, 34, 36.

Transfer layers 32 and 34 are each formed of a suitable extra fine lightweight film having a surface 52, 54 respectively carbonized to act as a carbon transfer agent. The surface of transfer films 32, 34 opposite to carbonized surfaces 52, 54 is such as to receive adhesive layers 22, 24 respectively of labels 12, 14; but so as to permit removal of labels 12, 14 therefrom. Thus, when information is placed upon surface 20 of upper label 12, by hand, typewriter, printing or other means, it is also applied to the information surfaces of labels 14 and 16 by the carbonized transfer layers 52, 54.

Labels 12, 14 and 16 are of a size (length and height) suitable for the intended purpose. For container labels one inch by two inches might be sufficient. When used for suitcases 2 inches by 3 inches might be more suitable; while for larger packages larger sizes can be selected.

Regardless of the size selected for labels 12, 14 and 16 it should be noted that the respective carrying layer 32, 34, 36 is sized to correspond to the height of the label but so as to extend wider than its respective layer to provide an attaching edge 62, 64, 66. For layers 32, 34 the attaching edge 62, 64 is provided by merely extending transfer film layers 32, 34 to so form the attaching edge. For layer 36 the release film is so extended to form attaching edge 66.

One or more fasteners, such as staples 18 are secured in place through attaching edges 62, 64, 66 to secure labels 12, 14, 16 together to form label set 10.

In use one need only place the desired information upon surface 20 of label 12. Application of the information can be by handwriting, typing or other impact printing and with sufficient pressure to enable the information to also be applied to the surfaces of labels 14 and 16 by the respective coacting carbonized layers 52, 54. After the information has been so applied bent over edges 42, 44, 46 can be lifted and labels 12, 14, 16 removed from their respective carrying layers 32, 34, 36 and applied to the package, luggage or other article. Obviously, one of such labels can be retained as a record (as for use in a drug store) intact with its backing, or removed therefrom and applied to a record card, book page, or the like. If only one label and a record copy is necessary, label set 10 can be assembled without intermediate label 14.

These labels will be especially useful in biochemical diagnostic laboratories, when it is necessary to divide each patient's blood or other body fluids into a series of test-tubes for specific testing of different chemical components.

It will thus be seen that there has been provided a novel and improved label set which is relatively simple in construction and use and well adapted to meet the conditions of practical use.

As various possible embodiments might be made of the above invention, and as various changes might be made in the embodiments above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby, since the embodiments of the invention particularly disclosed and described herein above are presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is, therefore, aimed in the appended claims to cover all such changes and modifications as fall within the true spirit and scope of the invention, and it is understood that, although I have shown the preferred form of my invention, that various modifications may be made in the details thereof, without departing from the spirit as comprehended by the following claims.

I claim:

1. A label set; comprising:

(a) a first label group;

(b) a second label group;

(c) fastening means attaching said first label group and said second label group together to form a label set;

(d) said first label group including at least a first label formed to a predetermined height and width from contact type film material and having an information surface and an adhesive surface of light tack self-stick type adhesive; and a first carrying member for said first label;

(e) said first carrying member being formed to a predetermined height and width and from film material with a first surface to removably receive said adhesive surface of said first label and a second surface coated with carbonized matter that will transfer to an adjacent surface when pressure is applied to said first surface of said carrying member;

(f) said second label group including at least a second label formed to a predetermined height and width from contact type film material and having an information surface and an adhesive surface of light tack self-stick type adhesive, and a second carrying member formed to a predetermined height and width for releasably carrying said second label by having said adhesive surface disposed against a surface thereof;

(g) said label set being assembled with said carbonized matter coated surface of said first label disposed proximate said information surface of said second label so that information applied to said first label with sufficient pressure will appear upon said second label.

2. The label set of claim 1, wherein said first label group includes a pair of labels each carried by a carrying member having a transfer surface coated with carbonized transfer matter and wherein the label set is assembled with each such transfer surface in contact with an adjacent labels information surface.

3. The label set of claim 2, wherein each carrying member is formed to a height that equals that of its associated label but with a width that extends past the width of its associated label to form an attaching edge for each carrying member, said fastening means securing said respective attaching edges together to form the label set.

4. The label set of claim 3, wherein said fastening means comprises at least one staple.

5. The label set of claim 2, wherein each label includes a bent over edge portion that is not secured by adhesive to said respective carrying member for said label to thus facilitate gripping of said label and removal of said label from its carrying member.

* * * * *